United States Patent [19]

Anthony

[11] Patent Number: 4,815,661

[45] Date of Patent: Mar. 28, 1989

[54] ULTRASONIC SPRAYING DEVICE

[75] Inventor: Jean M. Anthony, Antwerpen, Belgium

[73] Assignee: Tomtec N.V., Belgium

[21] Appl. No.: 80,781

[22] Filed: Aug. 3, 1987

Related U.S. Application Data

[63] Continuation-in-part of Ser. No. 855,968, Apr. 23, 1986, abandoned.

[30] Foreign Application Priority Data

Apr. 29, 1985 [BE] Belgium ..... 260677

[51] Int. Cl.[4] ..... B05B 1/08

[52] U.S. Cl. ..... 239/102.2; 239/590.3

[58] Field of Search ..... 239/102.2, 590.3, DIG. 23, 239/DIG. 19, 4

[56] References Cited

U.S. PATENT DOCUMENTS

| | | | |
|---|---|---|---|
| 2,717,614 | 9/1955 | Palivos | 239/600 |
| 2,855,244 | 10/1958 | Camp | 239/102.2 |
| 2,949,900 | 8/1960 | Bodine | 239/102.2 |
| 3,103,310 | 9/1963 | Lang | 239/102.2 |
| 3,812,854 | 5/1974 | Michaels et al. | 239/102.2 |
| 4,119,096 | 10/1978 | Drews | 239/102.2 |
| 4,635,857 | 1/1987 | Hughes | 239/590.3 |

FOREIGN PATENT DOCUMENTS

| | | | |
|---|---|---|---|
| 49636 | 4/1982 | European Pat. Off. . | |
| 2637162 | 1/1978 | Fed. Rep. of Germany . | |
| 193192 | 4/1967 | U.S.S.R. | 239/102.2 |

*Primary Examiner*—Douglas C. Butler
*Assistant Examiner*—Michael J. Forman
*Attorney, Agent, or Firm*—Scully, Scott, Murphy & Presser

[57] ABSTRACT

There is described an ultrasonic spraying device, comprised of a body wherein a core which generates piezoelectric vibrations, is arranged, said vibrations being conveyed to a spray nozzle which receives the liquid to be atomized, in which against the free end of said spray nozzle, a diaphragm is mounted which is so designed as to improve the atomizing characteristics of the liquid.

6 Claims, 2 Drawing Sheets

ULTRASONIC SPRAYING DEVICE

BACKGROUND OF THE INVENTION

This application is a continuation-in-part of prior application Ser. No. 855,968, filed Apr. 23, 1986, now abandoned.

This invention relates to an ultrasonic spraying device comprised of a body wherein a core which generates piezo-electric vibrations, is arranged, said vibrations being conveyed to a spray nozzle which receives the liquid to be atomized.

An object of the invention is to provide a device which markedly improves the atomizing features of the sprayed liquid.

Another object of this invention is to generate a compact bundle of microscopic moisture droplets in the form of a spray which, for a given vibration frequency, can be moved over a longer distance, and where the moisture particle size is smaller than usual.

The concept "compact" implies that the water droplets being spread by the spraying device and conveyed by the air, which form as it were a bundle, do not fall too fast downwards by gravity when leaving the spray nozzle, but should move as long as possible in a cone shape.

A device fitted with such a spray nozzle has already been described in Belgian Pat. No. 902,301. In a device as disclosed in said Patent, problems are encountered due to the sprayed liquid moving downwards soon after leaving the spray nozzle, in such a way that the surface area which is reached by the sprayed liquid, is relatively limited.

SUMMARY OF THE INVENTION

An object of the invention is to obviate said drawbacks and to provide a spraying device which makes it possible to cause the sprayed liquid to reach with a much higher homogeneity, at a relatively long distance, a large surface area.

To obtain such a result according to the invention, against the free end of said spray nozzle, a diaphragm is mounted which is so designed as to improve the atomizing characteristics of the liquid.

BRIEF DESCRIPTION OF THE DRAWINGS

Other details and features of the invention will be apparent from the following description, given by way of non-limitative example and with reference to the accompanying drawings, in which.

DETAILED DESCRIPTION OF THE PREFERRED EMBODIMENTS

Figure 1:
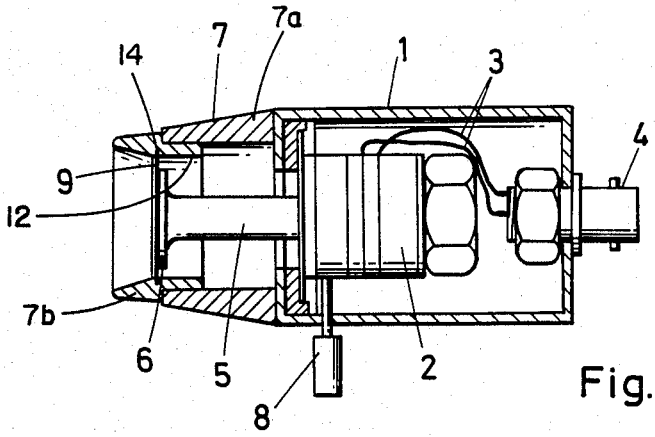
FIG. 1 is a partial lengthwise section through the spraying device according to the invention.

The device as shown in FIG. 1 comprises a body 1 wherein a core 2 is mounted, which comprises the required piezo-electric components to generate the desired ultrasonic vibrations. Reference number 3 refers to conductors which lead to connectors 4. The core 2 is joined to a spray nozzle 5, the free end 6 of which has for example, but not necessarily, an enlarged cross-section. Body 1 is linked to an extension 7, which surrounds completely said spray nozzle 5.

The supply of the liquid to be atomized comes from a supply 8 to a center channel provided in said spraying nozzle 5, although the liquid may also flow outwardly along the spray nozzle 5.

To improve substantially the atomizing characteristics of the sprayed liquid, according to the invention, a diaphragm 9 is provided in contact with the enlarged part 6 of spray nozzle 5.

The presence of said diaphragm 9, which contacts the enlarged part 6 of spray nozzle 5, comprises essentially the essence of the invention.

Although the spray nozzle shown by way of example has enlarged part 6, the invention may naturally also be applied to spray nozzles which have a completely different shape.

It has indeed been ascertained that atomizing of the liquid in a device fitted with the above-defined means for generating ultrasonic vibrations, occurs under particularly favorable conditions. Indeed, by atomizing the liquid through a diaphragm engaging a spray nozzle of the above-defined type, a bundle of microscopic liquid droplets is generated, and this bundle still has a compact structure at a suitable distance from said spraying device. Such a compact structure, the general appearance of which approximates a cone, is shown diagrammatically in FIG. 3.

Figure 2:
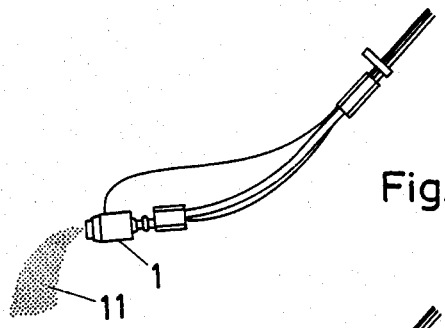
FIG. 2 shows diagrammatically a fluid bundle sprayed from an ultrasonic spraying device which is not fitted with a diaphragm.

When no use is made of a diaphragm according to the invention, the bundle generated by the spraying device occurs substantially according to the profile shown in FIG. 2.

In FIG. 2 it may indeed be noticed that the sprayed liquid droplets fall downwards directly after leaving the spray nozzle. This means also that the area which is reached by the sprayed liquid droplets is limited and is only a short a distance from the spray nozzle.

Such drawbacks are obviated with the spraying device according to the invention, whereby a cone-shaped bundle 10 is generated in a manner which allows the spray to reach longer distances, and to cover a larger surface area, in a more homogenous manner.

Diaphragm 9 may be made of a variety of materials. The diaphragm may be comprised of a fabric made from natural, synthetic, glass or carbon fibers, and the diaphragm may also be formed by a perforated material or a moisture-pervious non-woven material.

Remarkable results have been obtained with fibers which are manufactured by the Dupont de Nemours company under the trade name "KEVLAR".

A requirement lies in the diaphragm 9 engaging said spray nozzle 5. It is assumed that the vibrations being imparted to the diaphragm accelerates the liquid particles which flow through the diaphragm. It has also been determined that the air dynamics are changed by the use of such a diaphragm, and that there is a strong air displacement of the liquid particles which contributes to the displacement over the required distance.

Figure 3:
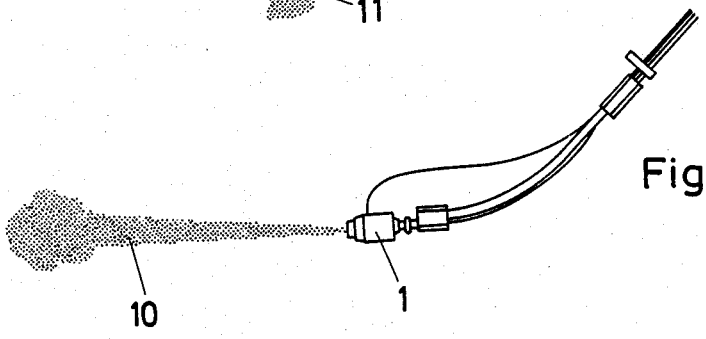
FIG. 3 shows a fluid bundle sprayed from a spraying device which is provided with a diaphragm according to the invention.

This explains why the bundle fluid or water droplets which appear thereby, acts as shown in FIG. 3, together with the acceleration of the surrounding air.

When the sprayed liquid, particularly those droplets which compose the spray, is not sufficiently accelerated, the result is a profile such as shown in 11 in FIG. 2, with all the drawbacks connected thereto.

With the embodiment illustrated in FIG. 1, extension 7 includes an inside surface 12 that extends around outlet 6 of nozzle 5, and this surface defines an inside, circumferentially extending groove 14. A ring is secured in the groove, and diaphragm 9 is held between this ring and nozzle 5 to atomize the liquid discharged from the nozzle outlet. Further, with this embodiment, extension 7 includes a first cylindrical member *7a* connected to and extending forward from body 1, and a second cylindrical member *7b* releasably connected to and extending forward form the first cylindrical member *7a*. Preferably, second member *7a* defines the above-mentioned circumferentially extending groove 14.

Figure 4:
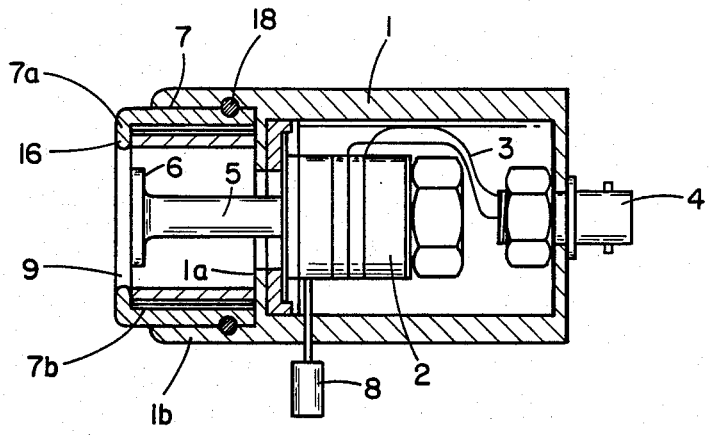
FIGS. 4 and 5 show alternate embodiments of the invention.
Figure 5:
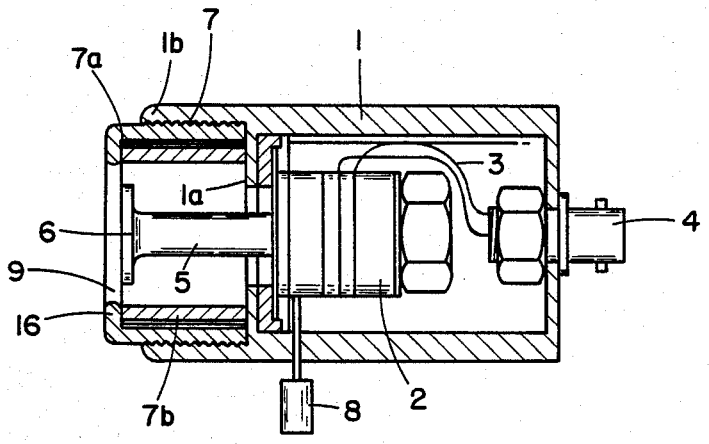

FIGS. 4 and 5 disclose alternate spraying devices also in accordance with this invention. These alternate devices include many elements, such as body 1, core 2, leads 3, connectors 4, spray nozzle 5 and diaphragm 9, that are either identical to or very similar to the corresponding element of the spraying device shown in FIG. 1, and it is not necessary to describe these elements of FIGS. 4 and 5 further.

The principle difference between the embodiment of FIG. 1 and the embodiments of FIGS. 4 and 5 relate to the construction of extension 7. With each of the embodiments shown in FIGS. 4 and 5, the first member *7a* of extension 7 is releasably connected to body 1, the second member *7b* of extension 7 is captured between part *7a* and body 1, and diaphragm 9 is capturec between members *7a* and *7b*. Preferably, first member *7a* includes a radially inwardly extending ring portion 16, and second member *7b* is axially captured between the ring portion and a radial flange 1*a* of body 1.

This arrangement is of utility for several reasons. First, it helps to assemble the ultrasonic spraying device; and, in particular, facilitates locating diaphragm 9 in place, and, if necessary, replacing the diaphragm. Second, preferably member *7a* may be moved forward and rearward at least slightly relative to the body of the spraying device, and this allows the pressure with whcih diaphragm 9 is held against nozzle 5 to be varied. Adjusting this pressure modifies within large ranges the characteristics of the nebulized liquid discharged from the spraying device.

With the arrangement shown in FIG. 4, outer member *7a* is in a tight pressure fit with a forward cylindrical portion 1*b* of body 1, and a seal 18 may be located between outer member *7a* and body portion 1*b* to prevent liquid from leaking through the interface between these two parts. Alternately, as shown in FIG. 5, outer member *7a* may be threaded onto forward cylindrical portion 1*b* of body 1.

What is claimed is:

1. An ultrasonic spraying device, comprising:

a body having a front end forming a body outlet;

a spray nozzle having front and back ends, said back end of the spray nozzle being held inside the body, the front end of the spray nozzle extending forward through the body outlet and forming a nozzle outlet;

means in fluid communication with the spray nozzle to conduct a liquid to and through the nozzle outlet;

a vibration generator secured within the body and connected to the back end of the spray nozzle, to generate piezo-electric vibrations and to vibrate the spray nozzle;

an extension member connected to the front end of the body, extending forward therefrom, and including an inside surface extending around the nozzle outlet and forming an inside, circumferentially extending groove;

a ring secured in the circumferentially extending groove, and located forward of the nozzle outlet; and a liquid permeable diaphragm held between and against the ring and the nozzle outlet to atomize the liquid conducted through the nozzle outlet.

2. An ultrasonic spraying device according to claim 1, wherein:

the extension member includes (i) a first cylindrical member connected to and extending forward from the body, and (ii) a second cylindrical member connected to and extending forward from the first cylindrical member; and the circumferentially extending groove is formed in the second cylindrical member.

3. An ultrasonic spraying device, comprising:

a body having a front end forming a body outlet;

a spray nozzle having front and back ends, said back end of the spray nozzle being held inside the body, the front end of the spray nozzle extending forward through the body outlet and forming a nozzle outlet;

means in fluid communication with the spray nozzle to conduct a liquid to and through the nozzle outlet;

a vibration generator secured within the body and connected to the back end of the spray nozzle, to generate piezo-electric vibrations and to vibrate the spray nozzle;

extension means releasably connected to the front end of the body, extending forward therefrom, and including (i) a first member releasably connected to and extending forward from the body, and (ii) a second member captured between the first member and the body; and a liquid permeable diaphragm captured between the first and second members of the extension means and held against the nozzle outlet to atomize the liquid conducted through the nozzle outlet.

4. An ultrasonic spraying device according to claim 3, wherein:

the first member of the extension means includes (i) an outside tubular portion, (ii) a ring portion extending inwardly from the outside tubular portion;

the body includes (i) an outside tubular shell, (ii) a flange portion extending inwardly from the tubular shell; and the second member of the extension means is axially captured between the ring portion of the first member of the extension means and the flange portion of the body.

5. An ultrasonic spraying device according to claim 3, wherein:

the body includes a cylindrical forward portion; and the first member of the extension means is in a pressure fit with said cylindrical forward position.

6. An ultrasonic spraying device according to claim 3, wherein:

the body includes a cylindrical forward portion; and the first member of the extension means is threaded onto said cylindrical forward portion.

* * * * *